United States Patent [19]

Ohlson

[11] Patent Number: 4,793,711

[45] Date of Patent: Dec. 27, 1988

[54] METHOD AND APPARATUS FOR THE BATCHWISE PRODUCTION OF PAVING MIXES CONTAINING MINERAL AGGREGATE AND BITUMINOUS BINDER

[76] Inventor: Karl G. Ohlson, Postlada 9073, S-281 00 Hässleholm, Sweden

[21] Appl. No.: 856,438

[22] Filed: Apr. 22, 1986

Related U.S. Application Data

[63] Continuation of Ser. No. 591,660, Mar. 20, 1984, abandoned, which is a continuation of Ser. No. 285,228, Jul. 20, 1981, Pat. No. 4,468,125.

[30] Foreign Application Priority Data

Aug. 1, 1980 [SE] Sweden ..... 8005503

[51] Int. Cl.[4] ..... B01F 15/04

[52] U.S. Cl. ..... 366/18; 366/152; 366/181; 366/141; 366/192

[58] Field of Search ..... 366/8, 18, 21, 30, 33, 366/37, 41, 188, 189, 192, 193, 161, 150, 151, 152, 179, 181, 141, 182, 184; 222/502, 503, 505, 558, 556; 166/281, 282

[56] References Cited

U.S. PATENT DOCUMENTS

| | | | |
|---|---|---|---|
| 1,304,619 | 5/1919 | Stamp | 366/8 |
| 1,623,001 | 3/1927 | Gollbach | 366/193 X |
| 2,425,942 | 8/1947 | Kooman | 366/188 |
| 2,840,271 | 6/1958 | Liljenberg | 222/556 X |
| 2,854,171 | 9/1958 | Trief | 222/558 X |
| 4,154,538 | 5/1979 | Linnhoff et al. | 366/188 |

*Primary Examiner*—Harvey C. Hornsby
*Assistant Examiner*—Frankie L. Stinson
*Attorney, Agent, or Firm*—Beveridge, DeGrandi & Weilacher

[57] ABSTRACT

In such batchwise production of a paving mix of mineral particles and bituminous binder, in which a coarse-grained portion of the mineral aggregate batch is first introduced in measured quantity into a container and then discharged through a discharge opening in the container, controlled by a discharge door into an asphalt mixer where the coarse-grained portion of the mineral aggregate batch is mixed with a batch of binder, whereupon the remaining, fine-grained portion of the mineral aggregate batch is introduced in measured quantity into the container and then discharged through the discharge opening into the mixer the time needed to discharge the fine-grained portion of the mineral material batch is controlled.

11 Claims, 1 Drawing Sheet

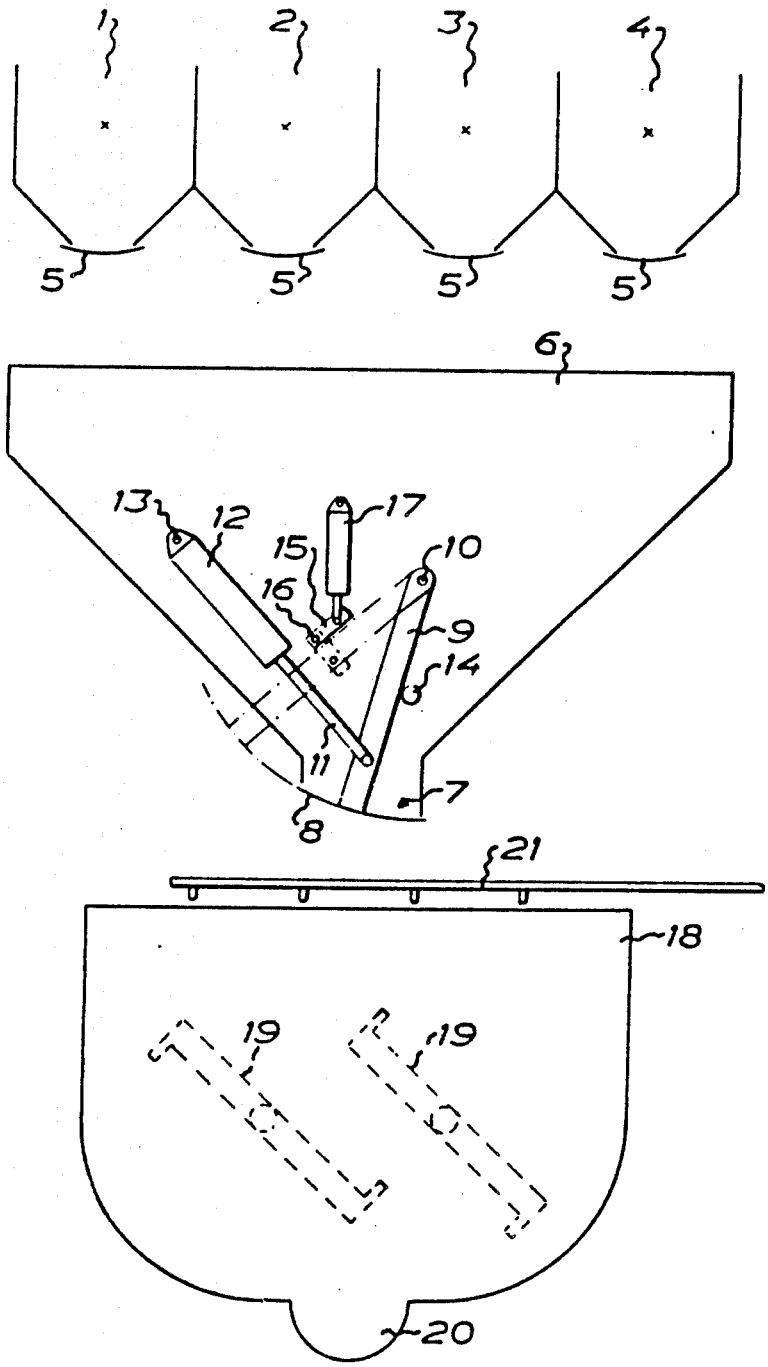
1
2
3
4
5
5
5
5
6
13
12
17
15
10
16
9
14
11
7
8
21
18
19
19
20

METHOD AND APPARATUS FOR THE BATCHWISE PRODUCTION OF PAVING MIXES CONTAINING MINERAL AGGREGATE AND BITUMINOUS BINDER

This application is a continuation of application Ser. No. 591,660 filed Mar. 20, 1984 and now abandoned which is a continuation of application Ser. No. 285,228 filed July 20, 1981 now U.S. Pat. No. 4,468,125.

This invention relates to a method and an apparatus for the batchwise production of a paving mix containing a batch of mineral aggregate with different sizes of particles, and a batch of bituminous binder.

More particularly, the invention has been developed for use with the method, disclosed by U.S. Pat. No. 3,868,262 of Feb. 25, 1975, of producing a paving mix by first introducing, into a container having a discharge opening with openable discharge door means, a coarse-grained portion of the mineral aggregate batch in measured quantity and then opening the door means for discharging the measured, coarse-grained portion through the discharge opening of the container into a continuously operating asphalt mixer in which the coarse-grained portion of the mineral aggregate batch is mixed with the entire binder batch, while the remaining fine-grained portion of the mineral aggregate batch is introduced in measured quantity into the container, whereupon the discharge door means of the container is opened for discharging the measured, fine-grained portion of the mineral aggregate batch through the discharge opening of the container into the mixer and finally the mixer is emptied after a certain time of admixture of the fine-grained portion of the mineral aggregate batch.

In the mixing operation according to said prior art method the binder batch which is liquid at the time of mixing, is first divided in the form of films onto the surfaces of the particles of the coarse-grained portion of the mineral aggregate batch before the particles of the fine-grained portion of the mineral aggregate batch are introduced into the mixer and by the mixing distributed onto and encapsulated in the binder films on the particles of the coarse-grained portion of the mineral aggregate batch. This method, in which the binder liquid is first mixed with the coarse-grained portion of the mineral aggregate batch, will have the effect that the liquid to mineral aggregate proportion is high when the particles of the fine-grained portion of the mineral aggregate batch flow into the mixer. This permits the binder liquid to be filled with the particles from the fine-grained portion of the mineral aggregate batch instead of the liquid being divided into films also on the particles from the fine-grained portion of the mineral aggregate batch. A division of the liquid into films on the particles from the fine-grained portion of the mineral aggregate batch results in thin liquid films, which implies with regard to the binder quantity of the mix that the mix will be too dry.

When said prior art method is utilized, it has been found that in spite of the mixing method there are encountered problems caused by a low proportion of liquid relative to the quantity of the fine-grained portion of the mineral aggregate batch.

The present invention eliminates these problems. The invention thus relates to a method of the type described above, in which the time needed for discharging the fine-grained portion of the mineral aggregate batch into the mixer, is controlled.

The invention also relates to an apparatus for carrying the above-described method into effect. The apparatus comprises a container having a discharge opening with openable discharge door means for successively receiving a coarse-grained portion and a fine-grained portion of a mineral aggregate batch in measured quantity and discharging said measured quantities through the discharge opening into a continuously operating asphalt mixer.

In one aspect of the apparatus of the invention, the discharge door means of the container is adjustable for control of the time needed for discharging the fine-grained portion of the mineral aggregate batch into the mixer.

The invention is based upon the discovery that the above-mentioned problems which upon application of the prior art method in question are encountered in a greater or smaller degree depending upon the type of asphalt mixing plant utilized and which are caused by a low proportion of binder liquid relative to the quantity of fine-grained portion of the mineral aggregate batch, in the final analysis are due to the flow of the fine-grained portion of the mineral aggregate batch to the mixer having been too large and produced a collection of fine-grained aggregate on top of the aggregate being admixed. As the binder is divided as films onto the particles from the coarse-grained portion of the mineral aggregate batch, said collection of fine-grained aggregate has resulted in that the proportion of binder to the quantity of fine-grained aggregate has become too low, whereby the liquid is not filled with particles but instead divided as films onto the particles, which is not desirable.

By controlling in accordance with the present invention the time needed for discharging the fine-grained portion of the mineral aggregate batch into the mixer, it is possible to prevent the temporary build-up, during the introduction of the fine-grained aggregate into the mixer, of so thick layers of fine-grained mineral aggregate on top of the composition being mixed in the mixer, as would arise if the discharge door means were opened as much and as quickly as when the coarse-grained portion of the mineral material batch is discharged into the mixer. To achieve the very best results said time for discharging the fine-grained portion of the mineral aggregate batch into the mixer should be so adapted to the admixing ability of the mixer being used that the fine-grained mineral aggregate supplied from the container to the mixer is admixed with the composition being mixed practically instantaneously without any build-up of disturbing thick layers of the fine-grained mineral aggregate on top of the composition.

If the paving mix shall contain, in addition to dust accompanying the mineral aggregate batch, a particularly added filler (mainly mineral particles of a size less than 0.09 mm) said filler should be added by means of a separate dosage apparatus simultaneously with the fine-grained portion of the mineral aggregate batch. The filler can be either supplied to the fine-grained portion of the mineral aggregate batch in the container before the discharge thereof or directly discharged into the mixer simultaneously as the fine-grained portion of the mineral aggregate batch is discharged into the mixer.

An embodiment of the apparatus according to the invention will be described more in detail hereinbelow with reference to accompanying drawing which diagrammatically shows the portion of interest of a batchwise operating asphalt mixing plant.

In the drawing, the lower portions of four mineral aggregate bins 1–4 are shown, in which supplies of four different portions of dried and heated mineral aggregate are kept in conventional manner. Bin 1 contains the most fine-grained portion, preferably grains of the size 0–2 mm. Bins 2–4 contain ever coarser mineral aggregate portions, e.g. 2–4 mm, 4–8 mm and 8–12 mm, respectively. In the usual manner the bins are each equipped with an openable discharge door 5.

Beneath the doors 5 of the bins 1–4 there is provided a container in the form of a weighing bin 6 which at its bottom has a discharge opening 7 with discharge door means. Said discharge door means has a door panel 8 which on opposite sides of the weighing bin is pivotally suspended with the aid of an arm 9 and a journal pin 10. On one side of the weighing bin 6 the arm 9 is pivotally connected to the piston rod 11 of a pneumatic piston and cylinder assembly, the cylinder 12 of which is pivoted on a pin 13 of the weighing bin. On the side of the weighing bin 6 there are provided a stationary stop 14 and an adjustable stop in the form of an arm 15 which is mounted on a journal 16 of the weighing bin and is adjustable between the position shown by full lines and the position shown by dash and dot lines by means of a pneumatic piston and cylinder assembly 17.

Beneath the discharge opening 7 of the weighing bin 6 there is positioned a conventional mixer comprising an open top container 18 with mixing blades 19 mounted therein, which continuously rotate when the asphalt mixing plant is used. At the bottom the mixer has a discharge device 20 for discharging a finished batch of paving mix. Through a sprinkling pipe 21 above the mixer heated bituminous binder can be sprinkled into the mixer.

When a batch of paving mix is to be produced the door 5 of the supply bin 4 is first opened temporarily for releasing mineral aggregate from the coarsest mineral aggregate portion into the weighing bin 6, the discharge door means of which occupies the position shown by full lines in drawing, with the door 8 closed. When the quantity of mineral aggregate released into the weighing bin has reached a predetermined weight the door of the bin 4 is closed in conventional manner. Then the door 5 of the bin 3 is temporarily opened for release of mineral aggregate from said bin into the weighing bin 6 and is closed when a predetermined quantity by weight of mineral aggregate from the bin 3 has been introduced into the weighing bin. In a corresponding manner, a batch of mineral aggregate is supplied from the bin 2.

When the coarse mineral aggregate batch of the paving mix batch has been weighed and collected in the weighing bin 6 in the prior art manner indicated, the discharge opening 7 of the weighing bin is opened fully and quickly by pivoting the door 8 with the aid of the piston and cylinder assembly 11, 12 to the position shown by dash and dot lines, while the arm 15 occupies the position shown by full lines. The coarse portion of the mineral aggregate batch then falls into the mixer 18 the mixing blades of which continuously rotate so that the mineral aggregate batch discharged thereinto is blended at the same time as a batch of heated liquid bituminous binder is sprinkled into the mixer through the pipe 21 in conventional manner and is caused by the blending effected to form liquid films on all surfaces of the mineral aggregate particles in the mixer.

Immediately after the weighing bin 6 has been emptied, the door 8 is again closed and the piston and cylinder assembly 17 is caused to adjust the arm 15 to the position shown in the drawing by dash and dot lines. After that the door 5 of the bin 1 is opened for weighing a batch of the fine-grained portion of the mineral aggregate of the paving mix batch. After the correct quantity by weight of fine-grained mineral aggregate has been supplied to the weighing bin and the blending of the coarse-grained portion of the mineral aggregate has been performed in the mixer for the desired time, the piston and cylinder assembly 11, 12 is again activated for opening of the door 8 . This time, however, the door 8 will not fully uncover the discharge opening 7 of the weighing bin since the arm 15 which occupies the position shown by dash and dot lines in the drawing, stops the arm 9 and thus the door 8 in an intermediate position. The discharge of the weighed fine-grained portion of the mineral aggregate from the weighing bin 6 to the mixer 18 will thus take place relatively slowly so that the mixer is given time to admix the arriving fine-grained mineral aggregate substantially according as it arrives. After emptying of the weighing bin 6 the door 8 is returned to closed position and the piston and cylinder assembly 17 will return the arm 15 to the position shown by full lines in the drawing into readiness for the production of a new batch of paving mix. After a given time of blending the discharge means 20 of the mixer 18 is opened for discharging the finished batch of paving mix.

The arm 15 of the discharge door means 8–17 can be given adjustable length to permit adaptation of the opening degree of the door 8, when the fine-grained portion of the mineral aggregate is discharged, to the admixing ability of the mixer and to various types of paving mixes.

I claim:

1. An apparatus for the batchwise production of a paving mix which contains a batch of mineral aggregate with different sizes of particles, and a batch of bituminous binder, comprising a container, means for successively introducing a coarse-grained portion and a fine-grained portion of a mineral aggregate batch in measured quantity into said container, a continuously operating asphalt mixer, a discharge opening in said container, discharge door means normally discharging said coarse-grained and fine-grained portions through said discharge opening into said asphalt mixer, said discharge door means including a door panel pivotally suspended beneath and normally closing said discharge opening, said discharge door means separately discharging said coarse-grained portion and said fine-grained portion of said aggregate batch into said asphalt mixer from said container, and adjustable stop means co-operating with said discharge door means after a shorter opening movement when discharging said fine-grained portion than when discharging said coarse-grained portion whereby said fine-grained portion is discharged at a predetermined discharge rate, said stop means including means for adjusting the position of said discharge door means to open to any degree intermediate between the closed position and the fully open position, said adjustable stop means including an arm for stopping movement of said door in intermediate positions between the closed position and the fully open position.

2. The apparatus as claimed in claim 1 wherein said discharge door means discharges said successively introduced coarse-grained and fine-grained portions successively through said discharge opening into said asphalt mixer.

3. The apparatus as claimed in claim 1 wherein said adjustable stop means further comprises a piston and cylinder assembly for positioning said second arm.

4. An apparatus according to claim 1 in which said door panel is suspended by a pivoted arm mounted on the container, and said arm of the adjustable stop means is operable to stop movement of said pivoted arm.

5. An apparatus for the batchwise production of a paving mix which contains a batch of mineral aggregate with different sizes of particles, and a batch of bituminous binder, comprising a container, means for successively introducing a coarse-grained portion and a fine-grained portion of a hot mineral aggregate batch in measured quantity into said container, a continuously operating asphalt mixer, a discharge opening in said container, discharge door means normally discharging said coarse-grained and fine-grained portions through said discharge opening into said asphalt mixer, said discharge door means including a door panel pivotally suspended beneath and normally closing said discharge opening, and adjustable stop means comprising means for adjusting said discharge door means to different openings as a means for adjusting the flow of fine-grained portion into the mixer to the admixing ability thereof, said adjustable stop means including an arm for stopping movement of said door in intermediate positions between a closed position and a fully open position.

6. The apparatus as claimed in claim 5 wherein said discharge door means discharges said successively introduced coarse-grained and fine-grained portions successively through said discharge opening into said asphalt mixer.

7. The apparatus as claimed in claim 5 wherein said adjustable stop means further comprises a piston and cylinder assembly for positioning said second arm.

8. An apparatus according to claim 5 in which said door panel is suspended by a pivoted arm mounted on the container, and said arm of the adjustable stop means is operable to stop movement of said pivoted arm.

9. An apparatus for the batchwise production of an asphalt paving mix from a batch of mineral aggregate of different sizes of particles and a batch of bituminous binder, comprising a container having a discharge opening therein, a continuously operating asphalt mixer, first means for introducing a coarse-grained portion of a mineral aggregate batch in measured quantity into said container, discharge door means normally discharging said coarse-grained portion through said discharge opening into said asphalt mixer, said discharge door means including a door panel pivotally suspended beneath and normally closing said discharge opening, means for discharging said bituminous binder into said asphalt mixer, second means for introducing a fine-grained portion of said aggregate batch into said container after said coarse-grained portion has been discharged into said asphalt mixer, adjustable stop means cooperating with said discharge door means to permit only a predetermined partial opening of said discharge opening so as to discharge said fine-grained portion through said partially opened opening at a predetermined discharge rate into said asphalt mixer, said adjustable stop means including an arm for stopping movement of said door in intermediate positions between the closed position and the fully opened position of said door panel, whereby said fine-grained aggregates are admixed with the coarse-grained aggregates and binder composition in said asphalt mixer without any build-up of thick layers of fine-grained aggregates on top of said composition.

10. The apparatus as claimed in claim 9 wherein said adjustable stop means further comprises a piston and cylinder assembly for positioning said second arm.

11. An apparatus according to claim 9 in which said door panel is suspended by a pivoted arm mounted on the container, and said arm of the adjustable stop means is operable to stop movement of said pivoted arm.

* * * * *